US006282860B1

(12) United States Patent
Ramirez

(10) Patent No.: US 6,282,860 B1
(45) Date of Patent: Sep. 4, 2001

(54) WIRE MESH SUPPORT

(76) Inventor: Jose G. Ramirez, P.O. Box 657, Hidalgo, TX (US) 78557

( * ) Notice: Subject to any disclaimer, the term of this patent is extended or adjusted under 35 U.S.C. 154(b) by 0 days.

(21) Appl. No.: 09/307,368

(22) Filed: May 7, 1999

Related U.S. Application Data

(60) Provisional application No. 60/084,718, filed on May 8, 1998.

(51) Int. Cl.[7] ..... E04C 5/16

(52) U.S. Cl. ..... 52/677; 52/686; 52/687; 52/689; 52/688

(58) Field of Search ..... 52/677, 686, 687, 52/689, 688

(56) References Cited

U.S. PATENT DOCUMENTS 1,070,921 * 8/1913 Saltiel ..... 52/686
3,693,310 * 9/1972 Middleton ..... 52/689
4,831,803 * 5/1989 Leonardis ..... 52/677
5,107,654 * 4/1992 Leonardis ..... 52/677
5,291,715 * 3/1994 Basile ..... 52/687
5,729,949 * 3/1998 Hartzheim ..... 52/677

* cited by examiner

*Primary Examiner*—Beth A. Stephan
*Assistant Examiner*—Dennis L. Dorsey
(74) *Attorney, Agent, or Firm*—Jackson Walker LLP

(57) ABSTRACT

A support device for a wire mesh. The wire mesh is held in place by the supporting device which includes legs and cup shaped members. The legs will stand on a support surface and the cup shaped members will engage the bars of the wire mesh to hold the wire mesh off the surface such that when concrete is poured into a form, the wire mesh will be properly located in the finished product.

8 Claims, 6 Drawing Sheets

WIRE MESH SUPPORT

This application claims benefit of provisional application Ser. No. 60/084,718 filed May 8, 1998.

FIELD OF THE INVENTION

Wire mesh supports, more particularly a wire mesh support intended to engage wire strands in cup-like members. The wire mesh engages the support at four points just outside the intersection of the wire strands.

SUMMARY OF THE INVENTION

Wire mesh, such as that used to reinforce poured concrete, is made up of wire strands arranged in a lattice pattern, that is, with one set of parallel wires strands; meeting a second set of parallel wires strands in generally perpendicular relation. When concrete is poured, wire mesh is laid down to help reinforce the concrete. However, the wire mesh is best supported above the floor of the slab and below the top of the slab. Prior art reinforcement is intended to support the wire mesh by supporting a single strand above the ground during the concrete pouring process. However, it is the inventor's experience that when such supports are used they are sometimes ineffective. More specifically, they care fall over and allow the mesh to sag or fall.

The foundation of a residential structure is affected by many forces acting on it from different axes. Engineering calculations show that concrete can be in compression or tension simultaneously. To avoid the failure of the concrete foundation, steel is added to the foundation to increase the carrying capacity of the concrete, principally in tension. The American Concrete Institute (ACI) in Section 318 of their code specifies that the rebar in a slab-on-grade foundation must be placed at the midpoint of the depth of the foundation. For example, in a four inch foundation slab, the rebar mat would normally be placed at two inch depth. Also, the ACI Concrete Code calls for the steel reinforcement in the concrete beans at all exterior and interior beams to have sufficient cover to avoid exposing needlessly the steel to the effects of moisture-penetrating corrosion. Once the steel is exposed to the effects of chemical-laden moisture, corrosion starts taking effect.

Applicant has, therefore, invented a new product which is effective in the process of laying down wire mesh and pouring concrete foundations. Applicant's new invention will help maintain engagement of wire mesh in the proper position near the middle part of the concrete foundation, between the base and the top of the poured slab.

Many contractors, because of the lack of a product(s) that places the steel at the correct depth in a uniform and efficient manner, do not install the steel reinforcement correctly. Many times, concrete laborers use stones (in different sizes) or pieces of broken bricks to support the steel mat (or cage in foundation beams) at the perpendicular intersection of rebar pieces. Since the pieces of stone or bricks are not uniform in size, the placement of the rebar ends up uneven. Another problem is that, while the foundation is being prepared, the workers step on the installed steel to go across the foundation. Sometimes this leads to the steel rebar falling off the support (stones or bricks). During the placement of the concrete, the workers must labor on top of the mat in a hurry. Consequently, the rebar might end up not at the mid-depth level as prescribed in the specifications. There are concrete foundation chairs out in the market. Some of the chairs perform well under ideal circumstances. But these chairs, either metal or plastic, normally have a single installation purpose.

Applicant's product is manufactured of heavy plastic. An illustration of the product and its use is set forth in FIGS. 1 to 9. It differs from the prior in that it is a single support which is intended to engage at least two stands of wire that are perpendicular to one another and to specifically engage those two strands at two points of typically equal distance from the intersection of the two strands. Further, where Applicant's wire mesh support engages the individual section of wires, a cup-like indent is provided to which the wire can either rest in or "snap" into for positive retainment.

It can be appreciated that by providing a wire mesh support which, instead of supporting a single wire strand at a single support point, provides a wire mesh support which engages perpendicularly aligned strands at four points equal distance from the junction of the strands, any movement of the wire mesh after the placement of a multiplicity of supports beneath the wire mesh would tend to cause the wire mesh supports to "slide" rather than topple over like the prior art.

BRIEF DESCRIPTION OF THE DRAWINGS

FIGS. 8A and 9B are top elevational and side elevational views of an alternate preferred embodiment of Applicant's wire mesh support.

DETAILED DESCRIPTION OF PREFERRED EMBODIMENTS

Please refer to FIGS. 1 through 4C. These figures illustrate a number of variations of Applicant's wire mesh support 10; however, each variation provides for, in a single wire mesh support, at least four (4) engagement points or cups 12A through 12D. It is also seen that cups 12A through 12D are engaged laterally so that they are all joined up by circular arm 14. The cups 12A through 12D are equally distant from one another so as to locate the intersection of the wire at the center of a plane in which the arms and cups lay.

Providing vertical support to the arms and cups arrangement are legs 16A through 16D, typically located just beneath each of the four cups 12A through 12D. Finally it is seen that legs 16A through 16D typically themselves are engaged with base 18. Base 18 may be ring shaped or rectangular.

Figure 1:
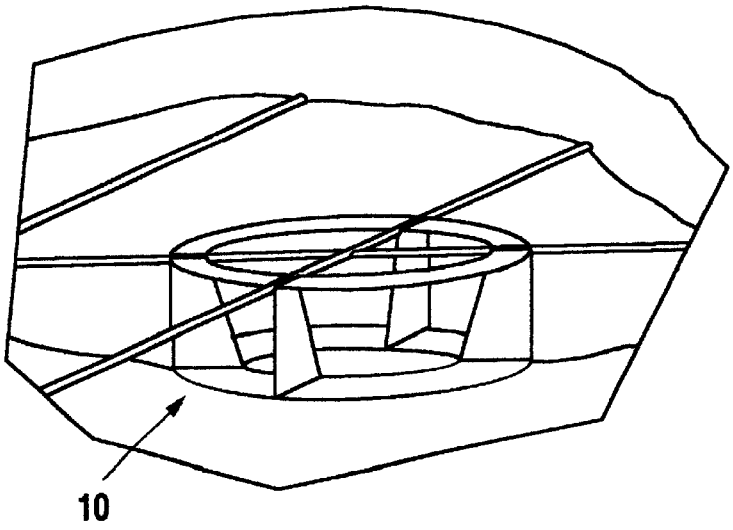
FIGS. 1 and 2 illustrate perspective views of Applicant's wire mesh support.
Figure 2:
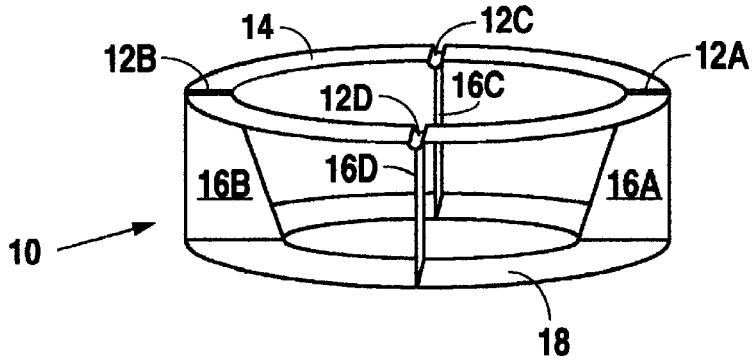
Figure 3:
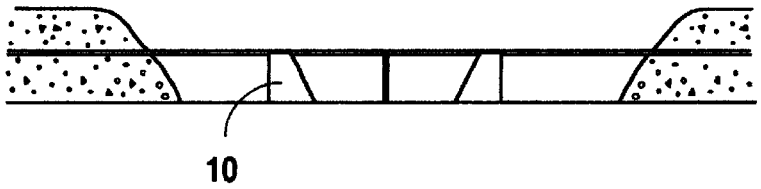
FIG. 3 illustrates a side elevational view of Applicant's mesh support shown in its useful environment supporting wire mesh which is intended for being embedded in concrete.
Figure 4A:
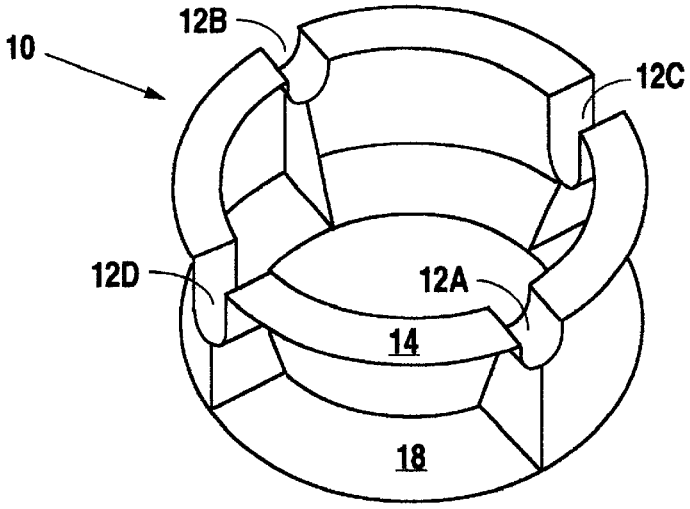
FIG. 4A is a perspective view of the wire mesh support of Applicant's present invention.
Figure 4B:
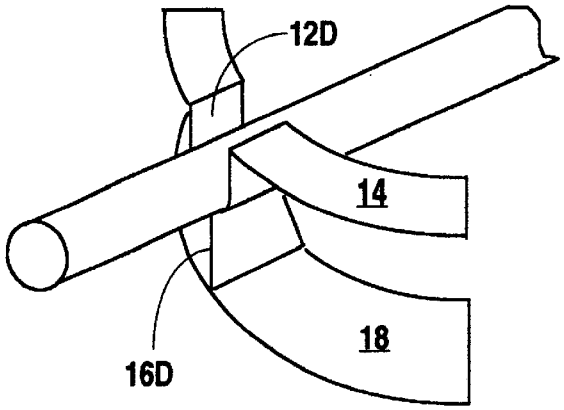
FIGS. 4B and 4C arc details of the cups of Applicant's wire mesh support in perspective views.
Figure 4C:
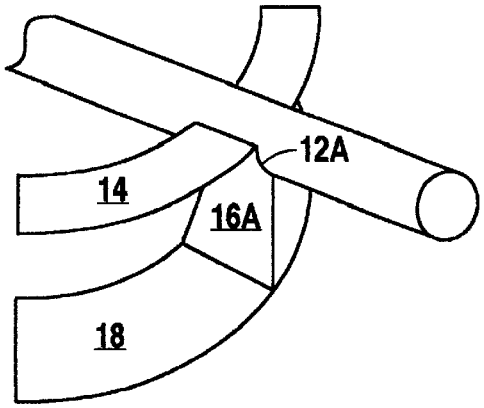

FIGS. 4A through 4C illustrate details of cups 12A through 12D of Applicant's wire mesh or slab reinforcement support. Specifically, they illustrate upper reinforcement which has a cup shape 12A and 12C in which the arch of the walls of the cup extend past 180 degrees so that the strands of wire can actually be pressed into the cup and the top lip of the cup will pop around the wire to capture it. On the other hand, as indicated in the illustration the lower cup shape 12B and 12D, the cups can be opened with the arch of the walls not exceeding 180 degrees. The wire strand can simply lay in these cups.

Material for Applicant's mesh support is typically bright orange molded plastic. The plastic may vary in thickness, but may typically be 6 gauge. The height of the cups above the base is typically between the range of 2" to 6", depending on the thickness of the slab. The product typically has a diameter (from one cup to the opposite cup) of about 10 inches, but may range from 6" to 14". The base is typically 1" to 2" wide and the arms are about 1 inch wide.

Applicant's wire mesh support is designed with cups to accommodate typical wire mesh sizes of ¼ inch, ⅜ inch, ½ inch, or the like.

The product is available in a variety of heights. It typically will hold the wire mesh tightly so that the wire mesh will stay at its proper embedded depth in typical concrete foundation. The product is typically hollow at the top, sides and/or bottom so that the concrete can easily flow through it. The stiff heavy plastic will help keep the wire mesh in place as the concrete is poured and will maintain its position and strength if stepped on by workers.

It is noted that the cup shape openings are intended to engage most or all of the wire so as to prevent the support from sliding around. It is noted with respect to FIGS. 4B and 4C that the upper reinforcement is for engaging the higher of the two wire strands (when the strands criss-cross, one wire is one diameter above the other) and may "snap fit". The lower reinforcement is for the lower wire, which rests in the bottom of the cup.

Figure 5:
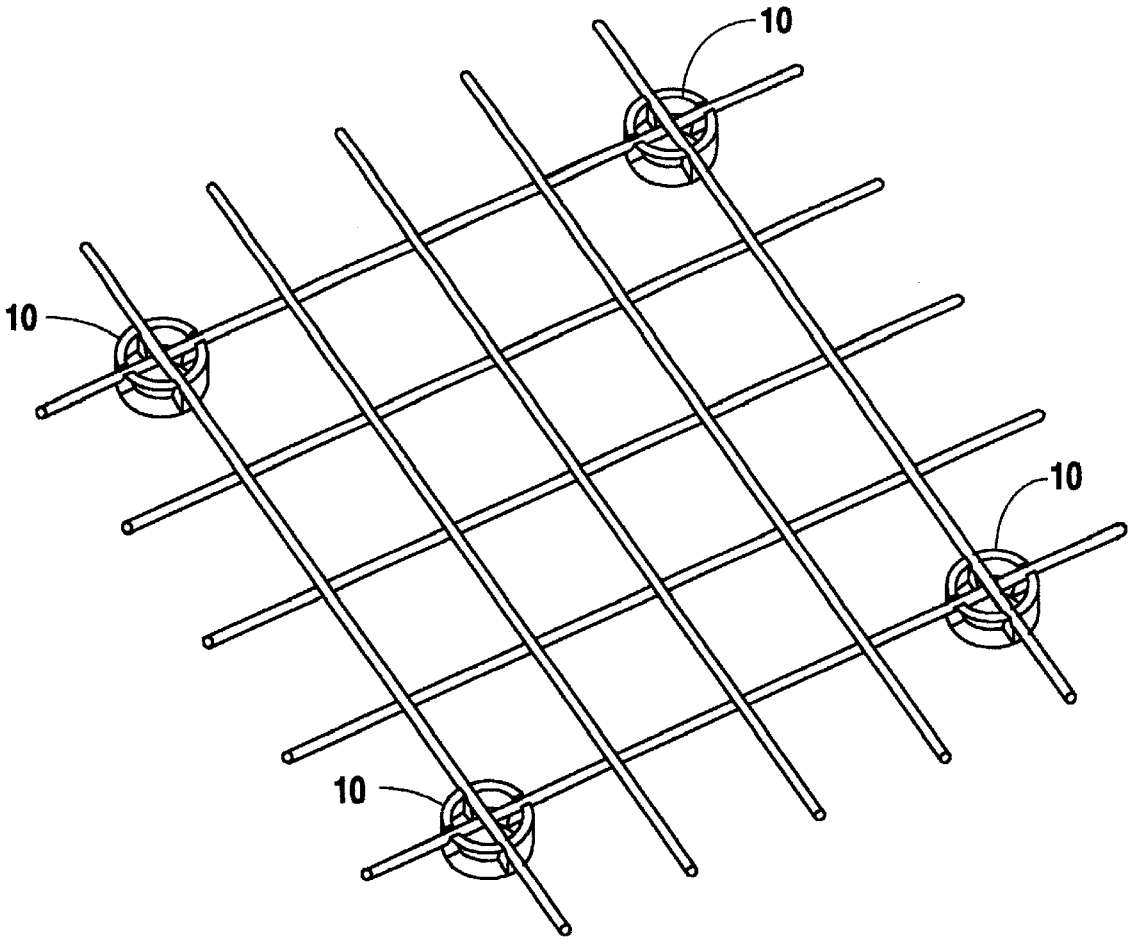
FIG. 5 is a perspective view of Applicant's wire mesh support in use supporting rebar.
Figure 6:
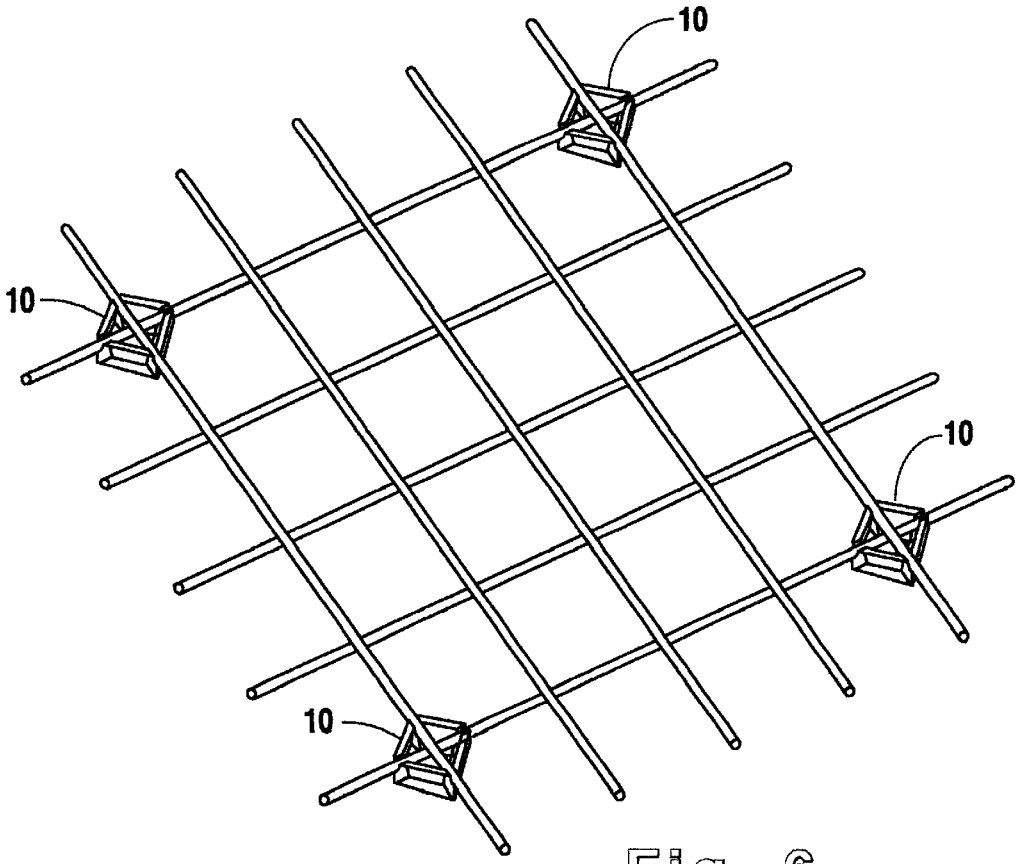
FIGS. 6 and 7 illustrate an alternate preferred embodiment of Applicant's wire mesh support in perspective views.

FIGS. 5 and 6 illustrate that the wire mesh support can, be placed at four feet on center for ⅜" and ½" re-bar wire or 6 foot on center for a ¼" re-bar wire. These are only suggested positioning and the dimensions are only suggested dimensions.

Figure 7:
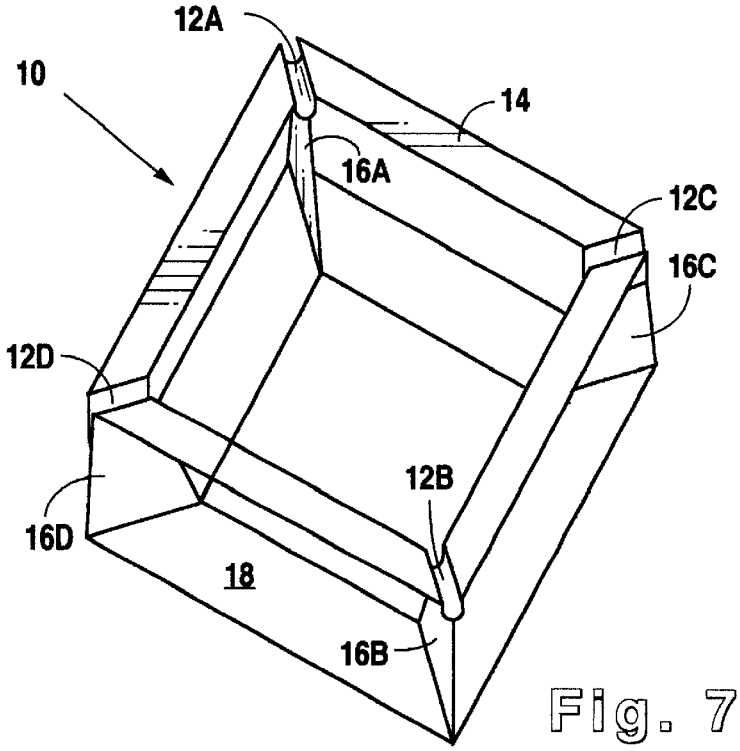

FIGS. 6 and 7 illustrate an alternate preferred embodiment of Applicant's present invention. More specifically, they illustrate the structure, dimensions and use of a rectangular version of Applicant's present invention. It can be seen with reference to FIG. 6 that the wire mesh support 10 may be placed at 6' intervals for ¼" wire mesh, or 4' intervals for ⅜" and ½" rebar.

With respect to FIG. 7, it is seen that the base 18 of the rectangular version of wire mesh support 10 may be 2" in width, and the height of the wire mesh support 2". The length and width is typically to the outer edges of the arms, about 10". The base is typically 2" wide and like the arms rectangular, typically 10" square.

Figure 8A:
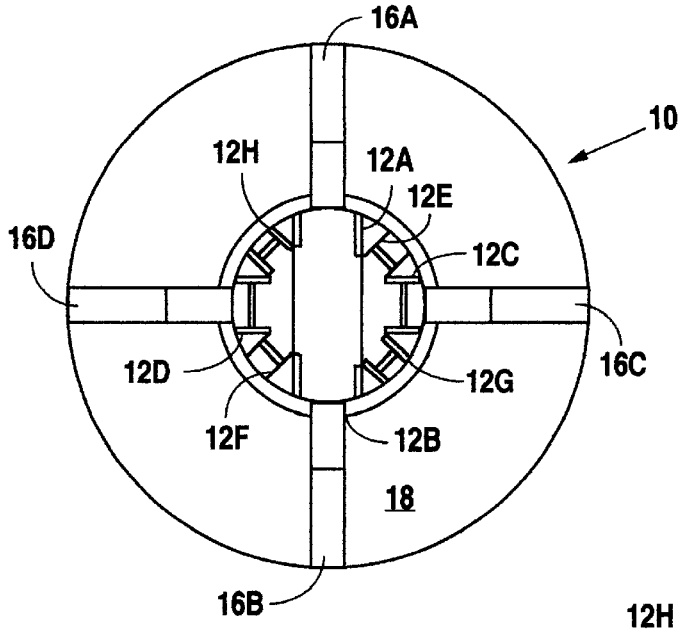
Figure 8B:
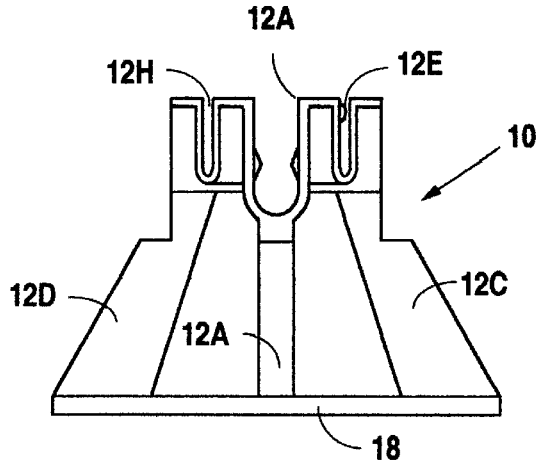
Figure 8C:
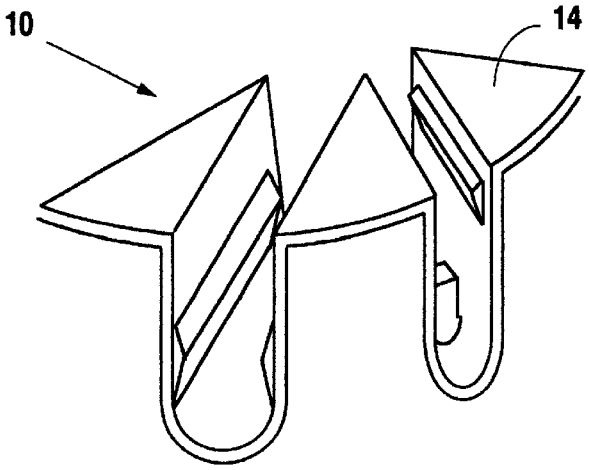
FIG. 8C illustrates details of the cups of the alternate preferred embodiment of Applicant's wire mesh support as set forth in FIGS. 8A and 8B, in perspective view, apart from the remainder of wire mesh support.

FIGS. 8A through 8C illustrate yet another alternate preferred embodiment of Applicant's present invention. This embodiment includes a second set of four cups 12E through 12H, which differ in width from the first set 12A through 12D. The first set of cups 12A through 12D may be used, for example, with ½" rebar, and the second set of cups, located offset 45° to the first set of cups, may be dimensioned so that the width of the cup is sufficient for ⅜" (or ¼") rebar. The point is, this alternate preferred embodiment allows a single support 10 to be used for rebar of two different widths.

Figure 9:
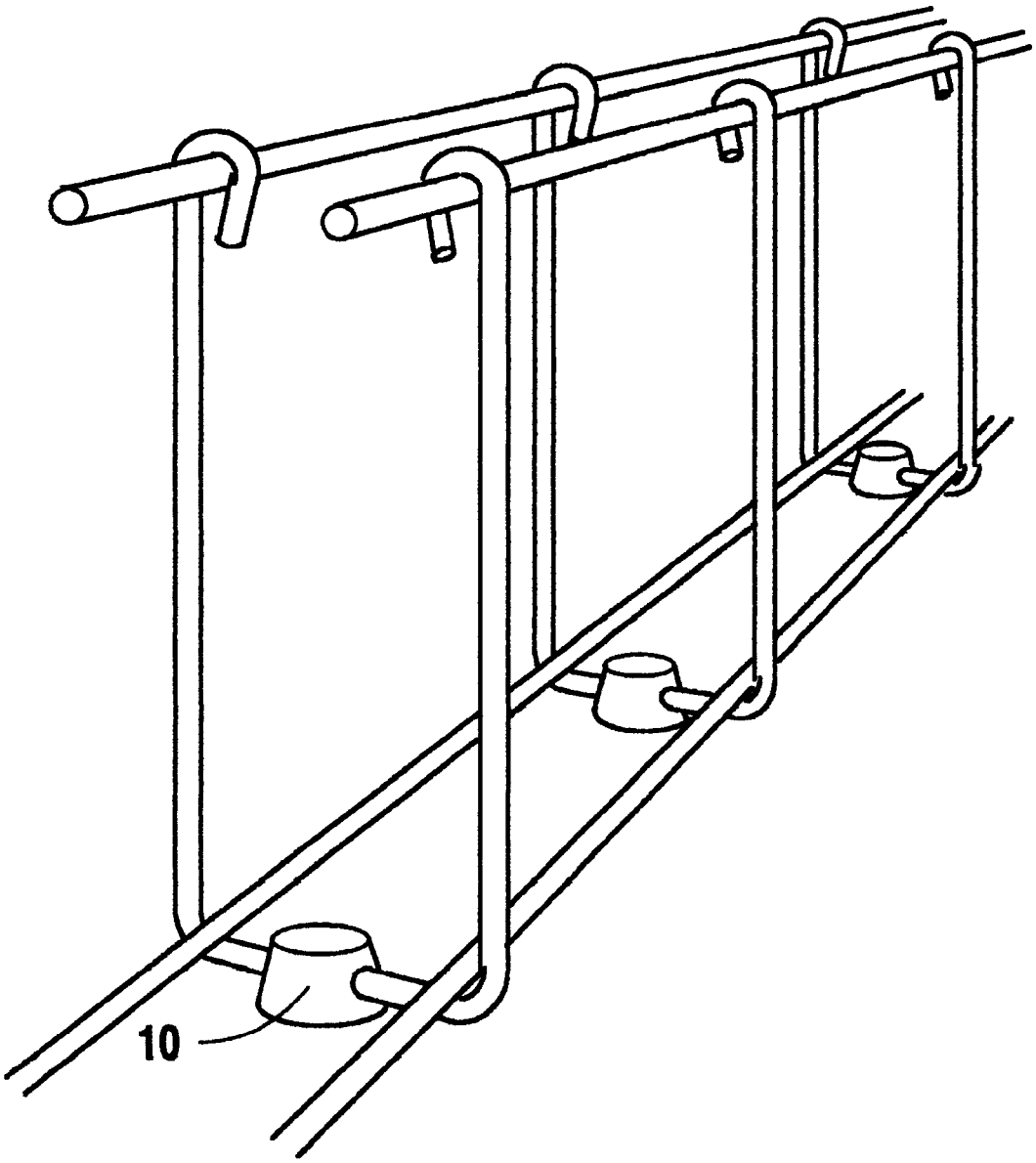
FIG. 9 illustrates in perspective view another use of Applicant's wire mesh support to vertically aligned "stirrups."

FIG. 9 illustrates yet another use of Applicant's wire mesh support. In this use, a pair of cups is used to vertically align a pair of vertical "stirrups," which stirrups are made of rebar, which is held at its lower end off the base through the use of Applicant's product where the lower ends of the rebar pop into the cup.

Concrete Foundation Deep Beams—Referring to the building codes, designers should place the steel rebar in the foundation beams with sufficient concrete cover to prevent the steel from coming in contact with the soil, moisture in the soil, frost damage (in cold weather), and naturally-occurring chemicals that could corrode the steel. The codes specify a minimal concrete cover for each face of the beam (side, bottom, and top). The most critical area, according to Ram &i Sons, is the bottom of the beam, where moisture from beneath the foundation can transmit to the concrete and the steel. The Ram and Sons plastic chair is specifically manufactured to snap into place into the stirrups of the beam steel cage assembly. When the steel rebar cage is placed in the beam, the plastic chairs offer a uniform height spacing with the bare ground.

Concrete Foundation Mat Rebar—in a similar situation, the building codes require that the steel rebar mat be placed at mid-depth of the foundation slab, typically about 4". As described previously, contractors usually utilize small stones or pieces of bricks to support the steel rebar mat. The Ram & Sons Plastic Chairs are manufactured so the steel rebar mat, typically interlaced ⅜" or ½" diameter steel) ends up at mid-height of the concrete foundation slab. The Ram & Sons Plastic Chair snaps at the intersection of perpendicular steel bars. The special design of the plastic chairs permits contractor personnel to walk over the mat without the mat falling off the chairs.

Concrete Flatwork Wire Mesh—The same requirement found in concrete foundation slabs applies to concrete flatwork, such as concrete approaches, concrete driveways, and sidewalks. Since the concrete flatwork will support much less weight than a concrete foundation, the use of welded steel wire mesh is permitted. Again, the Ram & Sons Plastic Chair is manufactured to snap at the intersection of the perpendicular pieces of typically W8 or W10 weight wire mesh.

Although the invention has been described with reference to specific embodiments, this description is not meant to be construed in a limited sense. Various modifications of the disclosed embodiments, as well as alternate embodiments of the inventions will become apparent to persons skilled in the art upon the reference to the description of the invention. It is, therefore, contemplated that the appended claims will cover such modifications that fall within the scope of the invention.

What is claimed is:

1. A device for supporting wire mesh above a surface when concrete is poured onto the surface and around the wire mesh, the wire mesh comprised of two sets of parallel wires intersecting in perpendicular relation creating a multiplicity of wire junctions, the device comprising;

a base for resting upon a support surface;

a multiplicity of similarly dimension legs, extending upward from the base;

a first set of four cups, the first set of four cups being comprised of two opposing pairs of cups, each pair of cups set at ninety degrees with respect to each other, wherein at least the first pair includes cups having a first width and a first depth and the second pair of cups includes cups having the first width and a second depth wherein the first depth is different than the second depth; and a second set of four cups, the second set of cups being comprised of two opposing pairs of cups, each pair set at ninety degrees with respect to the other, wherein at least the first pair of the second set of four cups includes cups having a second width and a first depth and the second pair also includes cups having the second width and a second depth, the width of the second set being different than the width of the first set wherein the first depth is different than the second depth;

arms extending laterally from the cups adjoining adjacent cups;

wherein the cups are equal distance from the adjacent cups.

2. The device of claim 1 wherein the wall of the cups includes means to retain wire mesh within the cups.

3. The device of claim 2 wherein means to retain wire mesh include projections in the walls of the cups.

4. The device of claim 1 wherein the base, legs, first and second set of cups are comprised of plastic.

5. The device of claim 1 wherein the width of the first set of cups is about ½ inch and the width of the second set of cups is one of either ⅜ inch or ¼ inch.

6. The device of claim 1 wherein the width of the first set of cups is about ¼ inch and the width of the second set of cups is about ⅜ inch.

7. The device of claim 5 wherein the base, legs, first and second set of cups are comprised of plastic.

8. The device of claim 6 wherein the base, legs, first and second of cups are comprised of plastic.

* * * * *